US008505725B1

(12) United States Patent
Adelusi-Adeluyi

(10) Patent No.: US 8,505,725 B1
(45) Date of Patent: Aug. 13, 2013

(54) SAND CEREMONY APPARATUS

(76) Inventor: Adewale Adelusi-Adeluyi, Houston, TX (US)

( * ) Notice: Subject to any disclaimer, the term of this patent is extended or adjusted under 35 U.S.C. 154(b) by 0 days.

(21) Appl. No.: 13/370,830

(22) Filed: Feb. 10, 2012

(51) Int. Cl.
*B65D 73/00* (2006.01)

(52) U.S. Cl.
USPC ..... 206/457; 206/467

(58) Field of Classification Search
USPC ..... 206/457, 461, 462, 463, 467; 40/790, 40/792
See application file for complete search history.

(56) References Cited

U.S. PATENT DOCUMENTS

| | | | | | |
|---|---|---|---|---|---|
| 4,457,103 | A | | 7/1984 | Aloziem | |
| 5,074,417 | A | * | 12/1991 | Kenny | 206/542 |
| 5,117,405 | A | * | 5/1992 | Thibault | 368/93 |
| 5,394,989 | A | * | 3/1995 | Delson | 206/457 |
| 5,450,690 | A | | 9/1995 | Elsea | |
| 5,456,046 | A | | 10/1995 | Vitalune et al. | |
| 5,582,883 | A | | 12/1996 | Keshishian | |
| 5,689,940 | A | * | 11/1997 | Weder | 53/475 |
| 5,755,327 | A | * | 5/1998 | Saltzman et al. | 206/457 |
| 6,050,414 | A | * | 4/2000 | Saffron et al. | 206/457 |
| 6,579,003 | B2 | * | 6/2003 | Glick et al. | 368/93 |
| 8,046,941 | B2 | * | 11/2011 | Schnuckle | 40/324 |
| 8,069,609 | B1 | * | 12/2011 | Towne et al. | 47/41.12 |
| 8,161,673 | B1 | * | 4/2012 | Kendall et al. | 40/800 |
| D673,344 | S | * | 12/2012 | Adelusi-Adeluyi | D99/19 |
| 2003/0201201 | A1 | * | 10/2003 | Cheng | 206/457 |
| 2004/0084345 | A1 | * | 5/2004 | Alonso | 206/457 |
| 2004/0085774 | A1 | | 5/2004 | Hsu | |
| 2004/0144675 | A1 | * | 7/2004 | Chen | 206/457 |
| 2008/0315046 | A1 | * | 12/2008 | Greto | 248/27.8 |
| 2009/0049743 | A1 | * | 2/2009 | Lewis, Jr. | 47/41.01 |
| 2009/0185454 | A1 | * | 7/2009 | Allen et al. | 368/93 |
| 2009/0205992 | A1 | * | 8/2009 | Williams | 206/457 |

* cited by examiner

*Primary Examiner* — Steven A. Reynolds
*Assistant Examiner* — King M Chu
(74) *Attorney, Agent, or Firm* — Egbert Law Offices, PLLC

(57) ABSTRACT

A sand ceremony apparatus has a sand receptacle with an opening at a top thereof and an interior volume suitable for the receipt of sand therein, a cover removably affixed over the opening and having a support surface formed thereon, and a decorative article removably positioned on the support surface of the cover. A structure that has an interior space in which the receptacle is received in the interior space. This structure include a first panel and a second panel. A first vase and a second vase are removably positioned in the structure on opposite sides of the sand receptacle.

9 Claims, 4 Drawing Sheets

SAND CEREMONY APPARATUS

CROSS-REFERENCE TO RELATED APPLICATIONS

Not applicable.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates to containers that are used during sand ceremonies. More particularly, the present invention relates to receptacles that can receive sand as poured by members of a wedding party. Additionally, the present invention relates to sand ceremony receptacles in which the sand can be displayed in an appealing and decorative manner.

2. Description of Related Art

Including Information Disclosed Under 37 CFR 1.97 and 37 CFR 1.98.

Wedding unity ceremonies have been in use as part of weddings for many years. Unity ceremonies have been incorporated into weddings because of the symbol and meaningful attributes that enhance the wedding experience. One example of a wedding unity ceremony is a unity candle ceremony. In such a unity candle ceremony, the bride and groom each receive a lit candle and use it to simultaneously light the unity candle. An officiant reads a corresponding ceremony of the couple's choice during this time. The lighting of the unity candle is viewed as symbolic of the union of marriage. This can be a touching addition to the wedding. The candle itself can become a keepsake which is reminiscent of the wedding day.

Another type of wedding unity ceremony is the sand ceremony. Sand ceremonies have gained great attention and popularity in recent years. During the sand ceremony, the bride and groom are instructed by the wedding official to each pour sand into a vase either one at a time or simultaneously. The sands are considered to be symbolic of the couple and their union of marriage. This corresponds to the lighting of the candle during the unity candle ceremony.

There has been a long felt need for an alternative to the unity candle ceremony. Many people desire to have a different approach to the conventional unity candle ceremony.

The sand ceremony has lacked an appropriate keepsake or heirloom vessel into which the sand is received. Additionally, many vases lack the ability to provide an attractive, easy-to-use mechanism for the opening and closing of the vase. Under certain circumstances, the vases can be relatively unattractive. Typically, in the past, the sands from the ceremony have not been ideally stored for the purposes of display and for the purposes of passing them down through generations of the family as a keepsake or heirloom. Additionally, many participants in such ceremony desire to display their wedding pictures simultaneously on or with the vessel.

Under many circumstances, the participants in the wedding ceremony desire to have some type of candle associated with the sand ceremony. Once again, the candle can be symbolic of the unity of the marriage. In under circumstances, the sand ceremony can be coupled with a unity candle ceremony. Unfortunately, devices have not been provided, in the past, which facilitate the ability to carry out both the sand ceremony and unity candle ceremony.

In the past, various patents have issued relating to items used in wedding ceremonies. For example, U.S. Pat. No. 4,457,103, issued on Jul. 3, 1984 to V. I. Aloziem, discloses decorative pottery having a glass outer layer, colored sand or salt as a middle layer and an inner layer of plaster of paris.

U.S. Pat. No. 5,450,690, issued on Sep. 19, 1995 to M J. Elsea, shows a floral bouquet holder which can be removably secured to the edge of a table. The holder includes a tube which is mounted to a bracket. The bracket is formed so that the holder may be mounted to tables of various widths. The holder may include an inner tube which is vertically slidable in the tube to which the bracket is secured.

U.S. Pat. No. 5,456,046 issued on Oct. 10, 1995 to Vitalune et al., shows a bouquet display apparatus that includes an adjustable clamp assembly which includes a medial strut portion. A pair of clamp portions extend transversely from the medial strut portion. An adjustable jaw member is connected to one of the clamp portions. The clamp portions are spaced apart from each other on the medial strut portion such that the clamp portions are adapted to clamp onto an edge of a table top. A flower holder assembly is adapted for removable and replaceable connection to the bracket holder portion. The flower holder assembly may include a flower holder portion adapted for holding a linear array of flowers or may include a flower holder portion adapted for holding a circular arrangement of flowers.

U.S. Pat. No. 5,582,883, issued on Dec. 10, 1996 to N. Keshishian, shows a portable religious shrine that has a portable enclosure with a plurality of compartments and a folding windscreen suitable for use in the burning of candles, the burning of incense, and the storage of objects.

U.S. Patent Publication No. 2004/0085774, published on May 6, 2004 to Y. S. Hsu, describes a candle lamp holder that includes a lighting element and a holder. The holder has an upper end formed on an inclined surface to hold the lighting element. The inclined surface enables the candle lamp to generate desired sensuous visual effects and three-dimensional lighting images when the candle lamp is energized.

U.S. Patent Publication No. 2009/0185454, published on Jul. 23, 2009 to Allen et al., shows a fillable hourglass having a glass component with opening permitting access to the inside of the glass component. A base with a least one opening in communication with the opening of the glass component. A stopper is provided for selectively opening and closing access to the glass component. The base is preferably formed from two planar members supported in spaced relation by decorative pillars. The stoppers may include decorative enhancements, such as being shaped in the design of a nautical steering wheel.

It is an object of the present invention to provide a sand ceremony apparatus that is suitable for receiving sand during the sand ceremony.

It is another object of the present invention to provide a sand ceremony apparatus that allows the vases and the receptacle to be displayed together.

It is another object of the present invention to provide a sand ceremony apparatus which can incorporate a unity candle therewith.

It is still a further object of the present invention to provide a sand ceremony apparatus that allows easy access to the interior volume of the sand receptacle so that the sand can be easily poured thereinto.

It is a further object of the present invention to provide a sand ceremony apparatus in which the sand receptacle has a decorative and attractive appearance.

It is still a further object of the present invention to provide a sand ceremony apparatus which allows the sand receptacles to be easily supported and displayed on any flat surface.

It is still a further object of the present invention to provide a sand ceremony apparatus that enhances the visual effect created by the pouring of different colors of sand into the sand receptacle.

It is still another object of the present invention to provide a sand ceremony apparatus which facilitates the ability to display images, such as photographs, in association with the sand.

These and other objects and advantages of the present invention will become apparent from a reading of the attached specification and appended claims.

BRIEF SUMMARY OF THE INVENTION

The present invention is a sand ceremony apparatus that comprises a sand receptacle having an opening at a top thereof and an interior volume suitable for the receipt of sand therein, a cover removably affixed over the opening, and a decorative article removably positioned on a support surface of the cover.

A structure is provided having an interior space. The sand receptacle is positioned in the interior space of the structure. The structure includes a first panel and second panel in generally and the spaced parallel relationship thereto. The sand receptacle is juxtaposed between the first panel and the second panel. A first vase is removably positioned in the structure adjacent to one side of the sand receptacle. A second vase is removably positioned in the structure adjacent to an opposite side of the sand receptacle. There can also be additional vessels that are part of the set but displayed outside of the structure. The main pair of the vases are representative of the bride and the groom. The additional vases can be representative of other members of the wedding party.

The cover has an indentation formed at a top surface thereof. The decorative article has a protrusion matingly received by the indentation. The decorative article can be a lamp having a bottom received by the support surface and a wick extending outwardly of a top thereof.

A display holder can be positioned within the sand receptacle. This display holder is suitable for displaying an image that can be viewed exterior of the sand receptacle. The display holder includes a first planar member and a second planar member resiliently connected to the first planar member so as to urge the first planar member away from the second planar member. The first planar member is urged against an inside surface of the first panel. The second planar member is urged against an inside surface of the second panel. A first photograph, or other image, can be interposed between the first panel and the first planar member. A second photograph, or other image, can be interposed between the second panel and the second planar member. The first planar member has a rod extending outwardly therefrom. The second planer member has a tubular member extending outwardly therefrom. The rod is received in an interior of the tubular member. A spring is positioned in the tubular member so as to have an end bearing against the rod.

The sand receptacle has an edge adjacent to the cover. This edge has a flange extending outwardly therefrom. The cover has a surface that rests upon the flange. The sand receptacle also has a surface at an edge adjacent the cover. This surface has a slot formed therein which extends toward the edge.

In the preferred embodiment of the present invention, the sand receptacle and the cover having a heart shape. In a first alternative embodiment of the present invention, the structure has a heart shape and the sand receptacle has a heart shape. In a second alternative embodiment of the present invention, the sand receptacle has a pair of circles in which a sand-receiving area is defined by a volume in which the pair of circles overlap. In a third embodiment of the present invention, the sand receptacle has a pair of heart-shaped structures in overlapping relationship in which a sand-receiving area is defined by a volume in which the pair of heart-shaped structure overlap. In a fourth alternative embodiment of the present invention, the receptacle and the cover define a generally circular member. The cover has an indentation at a top thereof.

DETAILED DESCRIPTION OF THE INVENTION

Figure 1:
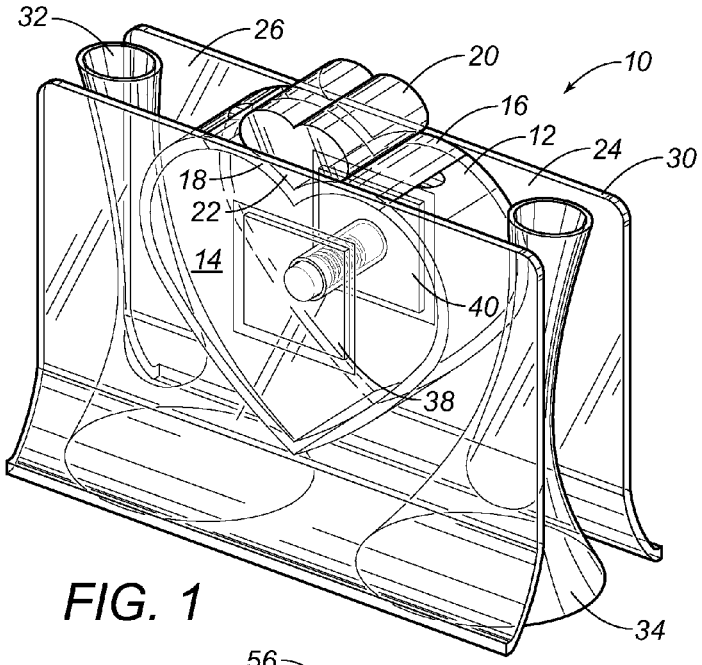
FIG. 1 is a perspective view showing the preferred embodiment of the sand ceremony apparatus of the present invention.

Referring to FIG. 1, there is shown the sand ceremony apparatus in accordance of the preferred embodiment of the present invention. The sand ceremony apparatus 10 includes a sand receptacle 12 having an opening at a top thereof. The sand receptacle 12 has an interior volume 14 suitable for the receipt of sand therein. A cover 16 is affixed over the opening of the sand receptacle 12. The cover 16 includes a support surface 18 formed thereon. A decorative article 20 is removably positioned on the support surface 18 of the cover 16.

In FIG. 1, it an be seen that the sand receptacle 12 and the cover 16 have a generally a heart shape. As such, this presents a decorative representation of the wedding ceremony. The heart shape of the sand receptacle 12 and the cover 16 define the interior thereof which is used for the receipt of sand therein. During the sand ceremony, the cover 16 and the decorative article 20 are removed so that the sand receptacle 12 and the interior volume 14 thereof are open for the receipt of sand therein.

The cover 16 is supported at the upper edges of the sand receptacle 12 adjacent to the opening thereof. The support surface 18 of the cover 16 includes an indentation which matingly receives a protrusion 22 of the decorative article 20. The decorative article 20, as shown in FIG. 1, is another heart-shaped member. The decorative article 20, as will be described hereinafter, can also be in the nature of a lamp having an interior volume suitable for the receipt of oil therein and a wick extending therefrom. As such, the decorative article 20 can be suitable for use in a dual sand and unity candle ceremony.

In FIG. 1, it can be seen that the structure 24 that has an interior space 26. The sand receptacle 12 is positioned in the space 26 of the structure 24. The structure 24 includes a first panel 28 and a second panel 30 arranged in generally parallel spaced relationship to each other. The sand receptacle 12 is juxtaposed between the first panel 28 and the second panel 30. Each of the first panel 28 and the second panel 30 are clear so as to allow for a viewing of the sand as positioned within the interior volume 14 of sand receptacle 12. A first vase 32 is removably positioned in the structure 24 adjacent to one side of the sand receptacle 12. A second vase 34 is positioned in the structure 24 adjacent to an opposite side of the sand receptacle 12. In particular, the vase 32 and 34 are positioned between the panels 28 and 30 of the structure 24. The vases 32 and 34 can be used during the sand ceremony so as to receive a particular color of sand therein. As such, when the groom pours one color of sand into the interior volume 14 of the sand receptacle 12, this color of sand will fill a portion of the interior volume 14. When the bride pours the second color of sand from the vase 34 into the interior volume 14 of the sand receptacle 12, then this second color of sand will mix with and reside upon the first color of sand. The pouring can continue in any desired manner so as to produce a particularly unique appearance within the interior volume 14 of the sand receptacle 12.

There is a display holder 36 positioned within the sand receptacle 12. The display holder 36 is suitable for displaying an image that can be viewed from the exterior of the structure 24. As can be seen, the display holder 36 includes a first planar member 38 and a second planar member 40. The first planar member 38 is urged against the inside surface of the first panel 28. The second planar member 40 is urged against the inside surface of the second panel 30. As such, and as will be described hereinafter, a photograph or other image, can be interposed between the surface of the first planar member 38 and the inside surface of the first panel 28 and another photo or image can be interposed between the surface of the second planar member 40 and the inside surface of the second panel 30. The mechanism for establishing a resilient relationship between the planar members 38 and 40 will be described hereinafter. Importantly, it should be noted, that when sand fills the interior volume 14 of the sand receptacle 12, this resilient connection between the planar members 38 and 40 will be covered with sand and will not be visible.

Figure 2:
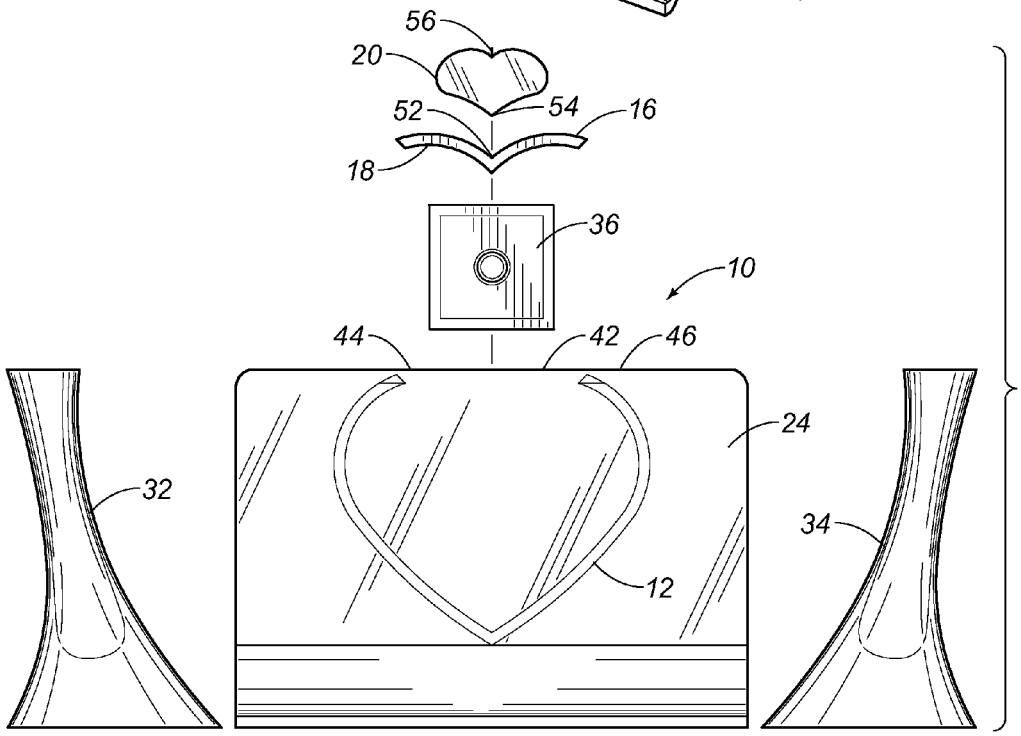
FIG. 2 is a frontal exploded view of the sand ceremony apparatus of the present invention.

FIG. 2 is an exploded view showing the configuration of the sand ceremony apparatus 10 of the present invention. Initially, it can be seen that the structure 28 has the sand receptacle 12 positioned therein. The sand receptacle 12 has its opening 42 illustrated as formed at an upper thereof. Importantly, the sand receptacle 12 has a first edge 44 on one side of the opening 42 and a second edge 46 at an opposite side of the opening 42. A small flange 48 is affixed to the sand receptacle 12 so as to extend outwardly and below the edge 44. Similarly, another flange 50 is affixed to the inside surface at the edge 46 and extends outwardly therefrom. The flanges 48 and 50 serve to support and retain the cover 16 when the cover 16 is placed over the opening 42. If the flanges 48 and 50 were not provided, then there would be the possibility of the cover 16 falling into the interior volume 14 of the sand receptacle 12. The flanges 48 and 50 assure the proper positioning of the cover 16.

In FIG. 2, the display holder 36 is of a size suitable for passing through the opening 42 of the sand receptacle 12. As such, a suitable photograph, or other image, can be placed against the planar members associated with the display holder 36 and the display holder 36 can then be installed into the sand receptacle 12.

After the sand has been poured from the vases 32 and 34 into the interior volume 14 of the sand receptacle 12, the cover 16 can be placed thereon. The cover 16 completes the image of the heart shape. In other words, the cover 16 includes the indentation 52 of the support surface 18. The decorative article 20 is illustrated as in the nature of a lamp. The decorative article 20 includes a protrusion 54 that is matingly received by the indentation 52 of the cover 16. The lamp 20 also includes a wick 56 at an upper end thereof. Following the pouring of the sand into the interior volume 14 of the sand receptacle 12, during the placement of the cover 16 over the opening 42, the decorative article 20 can then be placed onto the support surface 18 and then the wick 56 can then be lit so as to provide a candle-like appearance or be used as part of a unity candle ceremony.

Figure 3:
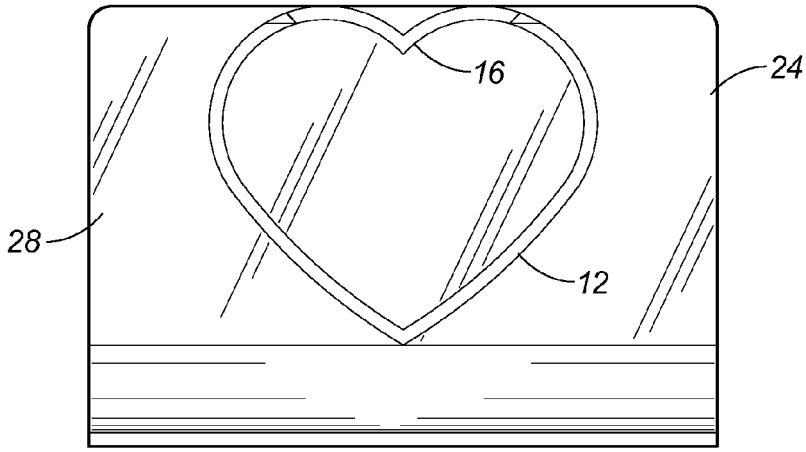
FIG. 3 is a frontal view of the sand ceremony as applied adjacent to the front panel of the sand ceremony apparatus of the present invention.

FIG. 3 shows the positioning of the sand receptacle 12 relative to the panel 28 of the structure 24. In FIG. 3, it can be seen that the heart shape of the sand receptacle 12 is completed by the placement of the cover 16 over the opening 42. As such, this attractive heart-shape receptacle can be displayed.

Figure 4:
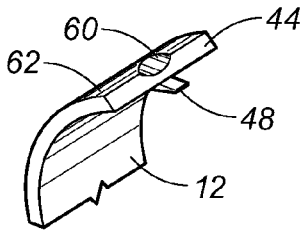
FIG. 4 is a perspective view showing the edge of the sand receptacle adjacent to the cover.

FIG. 4 illustrates the edge 44 adjacent to the opening 42 of the sand receptacle 12. The flange 48 is illustrated as extending outwardly of the edge 44. A small slot 60 is formed into the outer surface 62 of the receptacle 12 adjacent to the edge 44. The slot allows for access to the cover 16 once the cover has been placed against the edge 44 and upon the flange 48. As such, if it is necessary to remove the cover 16, a user can utilize his or her thumb, or other finger, in conjunction with the slot 60 so as to lift the cover 16, as desired. A similar slot can be formed adjacent to the edge 46 on the other side of the opening 42.

Figure 5:
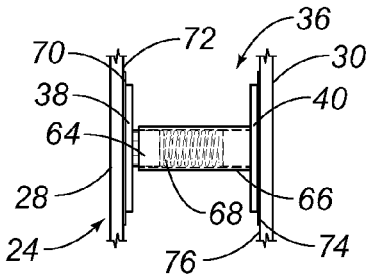
FIG. 5 is a cross-sectional view showing the display holder associated with the sand ceremony apparatus of the present invention.

FIG. 5 illustrates the display holder 36 associated with the present invention. In FIG. 5, the first panel 28 is illustrated as being in parallel spaced relationship to the second panel 30 of the structure 24. The display holder 36 includes the first planar member 38 and the second planar member 40. The first planar member 38 has a rod 64 extending outwardly therefrom. The second planar member 40 has a tubular member 66 extending outwardly therefrom. A spring 68 is received within the interior of the tubular member 66 so as to urge against the end of the rod 64. The rod 64 is introduced into the open end of the tubular member 66 so as to create a proper alignment therewith. The spring 68 urges the first planar member 38 against the first panel 28 and urges the second planar member 40 against the second panel 30 so as to create a frictional engagement therebetween.

In FIG. 5, it can be seen that there is first photograph 70 that is interposed between the outer surface of the first planar member 38 and the inside surface 72 of the first panel 28. Similarly, another photograph 74 is interposed between the outer surface of the second planar member 40 and the inside surface 76 of the second panel 30. As such, the display holder 36 urges the photographs 70 and 74 against the respective panels 28 and 30 so that these images can be viewed from the exterior of the structure 24. As used herein, the term "photographs" can include actual photographs, printed materials, or other images that are suitable for display. Typically, these photographs or other images will be in the nature of memorabilia associated with the wedding ceremony.

Figure 6:
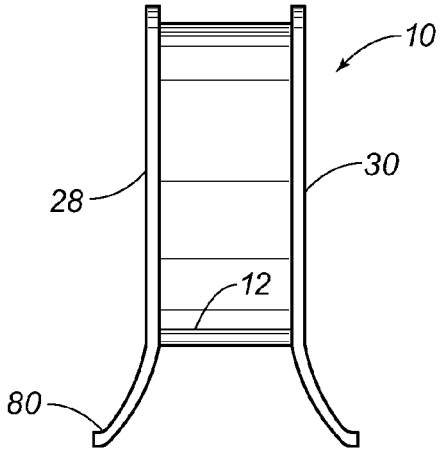
FIG. 6 is a side view of the sand ceremony apparatus of the present invention.

FIG. 6 shows an end view of the sand ceremony apparatus 10 of the present invention. In particular, it can be seen that there is the first panel 28, second panel 30, and the sand receptacle 12 positioned therebetween. Importantly, each of the panels 28 and 30 has an outwardly flared bottom 80. This outwardly flared bottom allows the sand ceremony apparatus to be adequately and securely supported upon an underlying surface.

Figure 7:
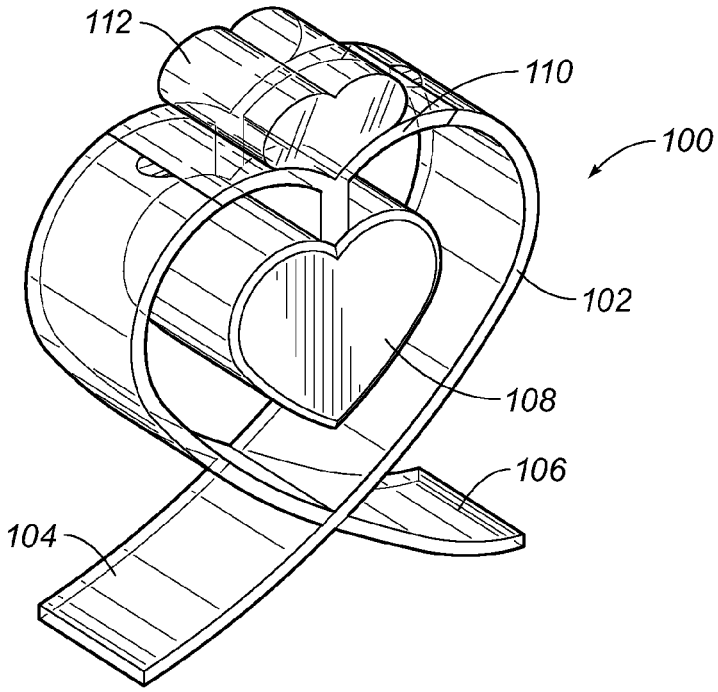
FIG. 7 is a perspective view of a first alternative embodiment of the sand ceremony apparatus of the present invention.

FIG. 7 shows an alternative embodiment of the sand ceremony apparatus 100 of the present invention. In FIG. 7, it an be seen that the structure 102 has a generally heart shape. Legs 104 and 106 extend outwardly at the bottom of the structure 102 so as to support the structure 102 upon an underlying surface. Each of the legs 104 and 106 is an extension of the sides of the structure 102. As such, the leg 104 and 106 project in a very attractive manner. The sand receptacle 108 is illustrated as positioned within the interior of the structure 102. Sand receptacle 108 also has a generally heart-shaped configuration. The sand receptacle 108 has an opening at an upper end thereof. The cover 110 is positioned over this opening. Similarly, the decorative article 112 is received within the indentation of the cover 110.

In the embodiment of FIG. 7, it can be seen that the opening associated with the sand receptacle 108 is relatively small. As such, a suitable funnel can be utilized so that the sand can be properly introduced into the interior volume of the sand receptacle 108. The cover 110 can then be placed over the small opening. The decorative article 112 can then be placed thereupon.

Figure 8:
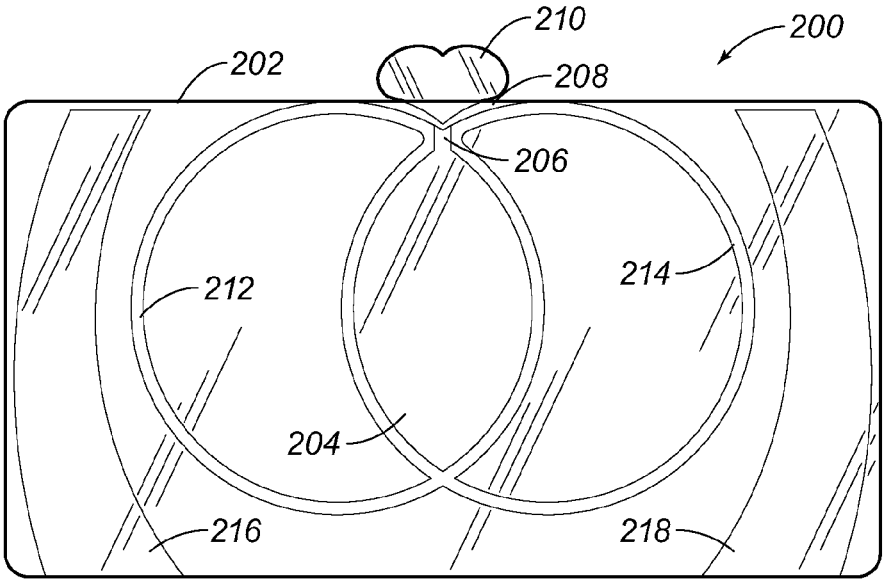
FIG. 8 is a frontal view of a second alternative embodiment of the sand ceremony apparatus of the present invention.

FIG. 8 shows a second alternative embodiment of the sand ceremony apparatus 200 of the present invention. The sand ceremony apparatus 200 includes a structure 202 that is formed of a first panel and second panel (in accordance with the teachings of the preferred embodiment of the present invention). The sand receptacle 204 has an opening 206 at an upper end thereof. The cover 208 is positioned over the opening 206. Decorative article 210 can then be placed upon the indentation of the cover 208.

In FIG. 8, the sand receptacle 204 is defined by the overlapping of a pair of circles 212 and 214. As such, the volume created by the overlapping circles 212 and 214 will create the sand receptacle 204. Sand is only received within the sand receptacle 204 and will not stray into the other portions of the circles 212 and 214 which do not overlap.

As with the preferred embodiment of the present invention, the sand ceremony apparatus 200 includes a first vase 216 and second vase 218 that is positioned between the panels of the structure 102. Panel 216 is adjacent to the outer periphery of the circle 212. Vase 218 is adjacent to the outer periphery of the circle 214.

Figure 9:
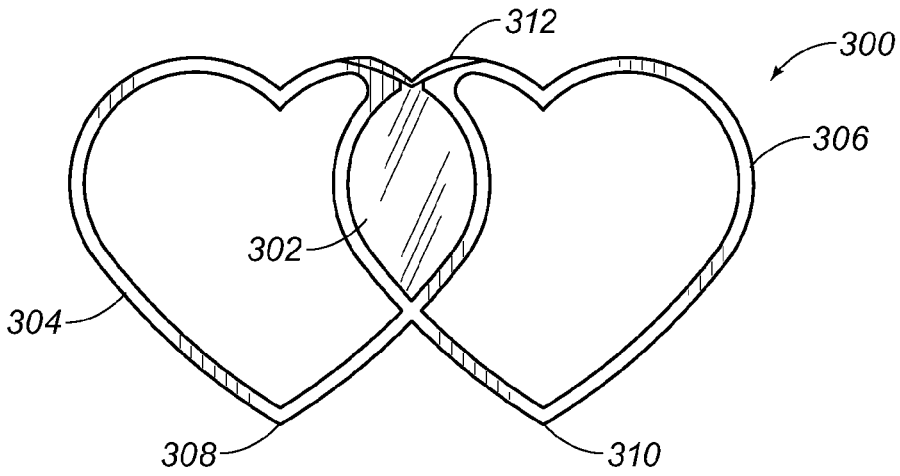
FIG. 9 is a frontal view of a third alternative embodiment of the sand ceremony apparatus of the present invention.

FIG. 9 shows a third alternative embodiment of the sand ceremony apparatus 300 of the present invention. The sand ceremony apparatus 300 includes a sand receptacle 302 that is formed by the overlapping portions of a first heart-shape member 304 and a second heart-shape member 306. The bottoms 308 and 310 of the heart-shape members 304 and 306, respectively, form the bottom of the sand ceremony apparatus 300. Sand is received within the interior volume of the sand receptacle 302 and does not stray into the other non-overlapping portions of the heart-shape members 304 and 306. A cover 312 is positioned over the opening to the interior volume of the sand receptacle 302 in the manner described hereinbefore. The apparatus 400 can have a decorative article, such as a unity heart, thereon. A pair of side vases can also be provided, in a manner similar to the previous embodiments.

Figure 10:
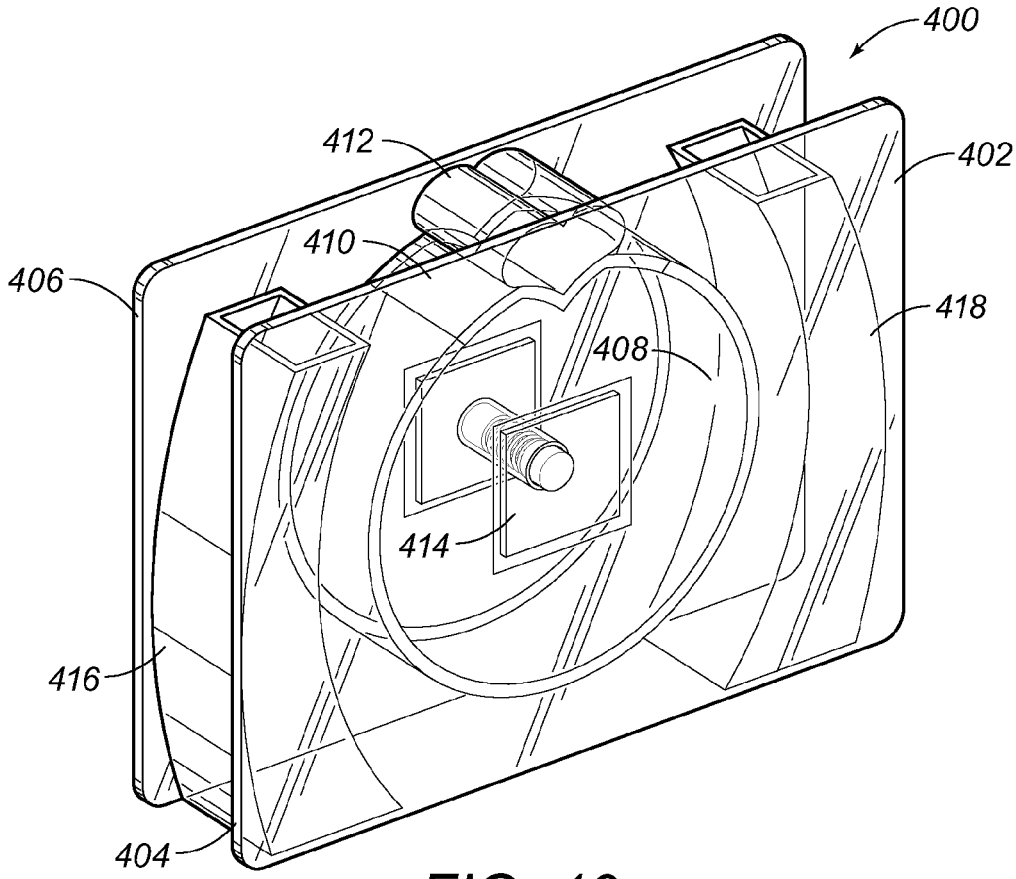
FIG. 10 is a perspective view of a fourth alternative embodiment of the sand ceremony apparatus of the present invention.

FIG. 10 shows a fourth alternative embodiment of the sand ceremony apparatus 400 of the present invention. The sand ceremony apparatus 400 includes a structure 402 formed of a first panel 404 and a second panel 406. Panels 404 and 406 are in spaced parallel relationship to each other and are transparent. The sand receptacle 408 is juxtaposed between the panels 404 and 406. In this embodiment of the sand ceremony apparatus 400 of the present invention, the sand receptacle 408 has a generally circular or annular shape. The cover 410 is positioned over the opening of the sand receptacle 408 in the manner described hereinbefore. The decorative article 412 is received in the indentation of the cover 410 in the manner described hereinbefore. The display holder 414 is positioned on the interior of the sand receptacle 408 in the manner described hereinbefore. Vases 416 and 418 are positioned adjacent to opposite sides of the sand receptacle 408. Apparatus 400 can also include three side vases.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. A sand ceremony apparatus comprising:
- a sand receptacle having an opening at a top thereof, said sand receptacle having an interior volume suitable for the receipt of sand therein;
- a cover removably affixed over said opening, said cover having a support surface formed thereon;
- a decorative article removably positioned on said support surface of said cover; and
- a display holder positioned within said sand receptacle, said display holder suitable for displaying an image that can be viewed exterior of the sand receptacle, said display holder comprising:
  - a first planar member;
  - a second planar member resiliently connected to said first planar member away from said second planar member;
  - a first panel; and
  - a second panel in generally spaced parallel relation to said second panel, said sand receptacle being juxtaposed between said first panel and said second panel, said first planar member being urged against an inside surface of said first panel, said second planar member being urged against an inside surface of said second panel.

2. The sand ceremony apparatus of claim 1, further comprising:
- a structure having an interior space, said sand receptacle positioned in said interior space of said structure.

3. The sand ceremony apparatus of claim 2, said structure comprising:
- a first panel; and
- a second panel in spaced generally parallel relation to said first panel, said sand receptacle being juxtaposed between said first panel and said second panel.

4. The sand ceremony apparatus of claim 2, further comprising:

a first vase removably positioned in said structure adjacent to one side of said sand receptacle; and a second vase removably positioned in said structure adjacent to an opposite side of said receptacle.

5. The sand ceremony apparatus of claim 1, further comprising:

a first photograph interposed between said first panel and said first planar member; and a second photograph interposed between said second panel and said second planar member.

6. A sand ceremony apparatus comprising:

a sand receptacle having an opening at a top thereof, said sand receptacle having an interior volume suitable for the receipt of sand therein;

a cover removably affixed over said opening, said cover having a support surface formed thereon;

a display holder positioned within said sand receptacle, said display holder suitable for displaying an image that can be viewed exterior of the sand receptacle, said display holder comprising:

a first planar member;

a second planar member resiliently connected to said first planar member away from said second planar member, said first planar member having a rod extending outwardly therefrom, said second planer member having a tubular member extending outwardly therefrom, said rod received in an interior of said tubular member, the apparatus further comprising:

a spring positioned in said tubular member and having an end bearing against said rod; and a decorative article removably positioned on said support surface of said cover.

7. The sand ceremony apparatus of claim 1, said sand receptacle having an edge adjacent to said cover, said edge having a flange extending outwardly therefrom, said cover having a surface resting upon said flange.

8. The sand ceremony apparatus of claim 1, said sand receptacle having a surface at an edge adjacent said cover, said surface having a slot formed therein and extending toward said edge.

9. The sand ceremony apparatus of claim 1, said sand receptacle and said cover having a heart shape.

* * * * *